US006062769A

United States Patent [19]

Cunningham

[11] Patent Number: 6,062,769

[45] Date of Patent: May 16, 2000

[54] ENHANCED STEEL CATENARY RISER SYSTEM

[75] Inventor: Christopher E. Cunningham, Spring, Tex.

[73] Assignee: FMC Corporation, Chicago, Ill.

[21] Appl. No.: 09/370,051

[22] Filed: Aug. 6, 1999

Related U.S. Application Data

[60] Provisional application No. 60/095,395, Aug. 6, 1998.

[51] Int. Cl.[7] ..... E02D 23/00; E02D 27/24

[52] U.S. Cl. ..... 405/195.1; 405/169; 405/170; 405/223.1; 405/224; 405/224.2; 166/350; 166/367

[58] Field of Search ..... 405/195.1, 223.1, 405/224, 224.1, 224.2, 224.3, 224.4, 169, 170, 171; 166/350, 367; 114/230

[56] References Cited

U.S. PATENT DOCUMENTS

| | | | |
|---|---|---|---|
| 3,111,926 | 11/1963 | Shatto, Jr. | 114/230 X |
| 3,602,174 | 8/1971 | Gorman | 114/293 |
| 4,155,673 | 5/1979 | Yashima | 405/224 |
| 4,371,037 | 2/1983 | Aranudeau | 166/367 X |
| 4,430,023 | 2/1984 | Hayes et al. | 405/224 |
| 4,459,066 | 7/1984 | Van Der Graaf | 405/195.1 |
| 4,462,717 | 7/1984 | Falcimaigne | 405/195.1 |
| 4,470,724 | 9/1984 | Pollack | 405/224 X |
| 4,648,848 | 3/1987 | Busch | 114/230 X |
| 4,661,016 | 4/1987 | Baugh et al. | 405/169 |
| 4,793,737 | 12/1988 | Shotbolt | 405/195.1 X |
| 4,906,137 | 3/1990 | Maloberti et al. | 405/195.1 |
| 5,505,560 | 4/1996 | Brown et al. | 405/195.1 |
| 5,639,187 | 6/1997 | Mungall et al. | 405/195.1 |

*Primary Examiner*—Eileen Dunn Lillis
*Assistant Examiner*—Jong-Suk Lee
*Attorney, Agent, or Firm*—Gary L. Bush; Mayor, Day, Caldwell & Keeton, LLP.

[57] ABSTRACT

A riser arrangement increases the stability and/or decreases sensitivity to vortex induced vibration of risers of a riser system including steel tubular lines, SCRIBS and flexible hose risers leading to a floating storage/production vessel. A cross-link is placed between two or more steel tubular lines in order to enhance the stability of the riser system. Devices are coupled to the steel tubular lines for increasing their tension in order to increase the natural frequency of vibration in order to reduce sensitivity to vortex induced vibration.

11 Claims, 7 Drawing Sheets

TO INSTALLATION VESSEL
84
84
80
80
82
96
94
94
90
98
90
92
92
32

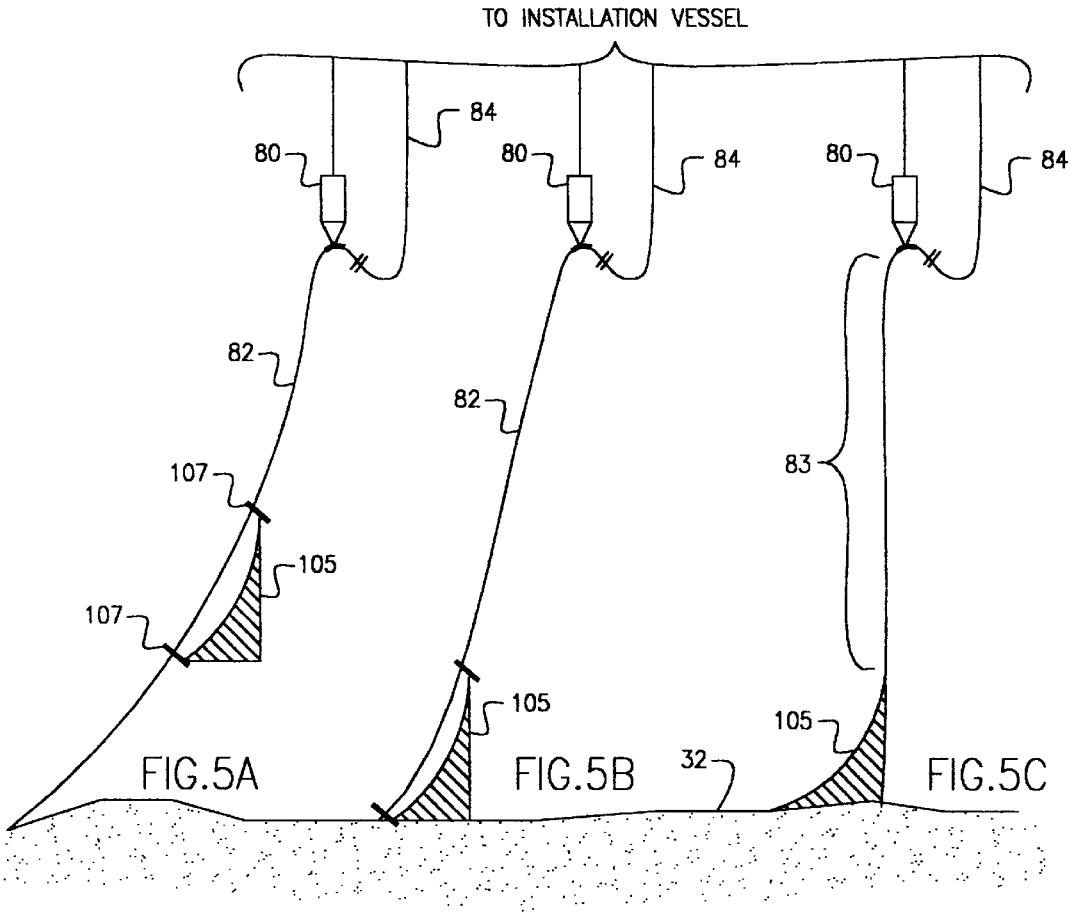
TO INSTALLATION VESSEL
80
84
82
107
105
83
32
FIG.5A
FIG.5B
FIG.5C
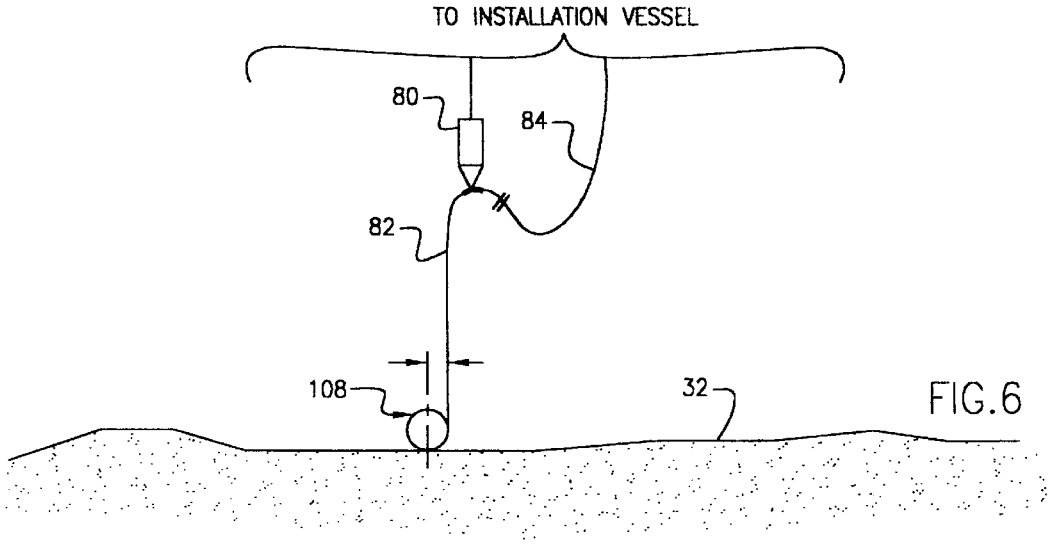
TO INSTALLATION VESSEL
80
84
82
108
32
FIG.6

ENHANCED STEEL CATENARY RISER SYSTEM

CROSS REFERENCE TO PRIOR APPLICATION

This application claims priority from Provisional Application 60/095,395 filed on Aug. 6, 1998.

BACKGROUND OF THE INVENTION

1. Field of the Invention

This invention relates generally to riser system arrangements for offshore floating facilities such as floating production, storage, and off loading vessels (FPSOs) and including hybrid riser systems extending from the sea floor to the moored vessel for the transport of hydrocarbon fluids. The invention is particularly directed to riser arrangements or systems for stabilizing the upper ends of simple catenary risers, which are in turn connected by way of relatively more flexible riser elements to a moored vessel or other floating facility.

2. Description of the Prior Art

Prior riser systems have included flexible risers which may or may not be continuations of seabed flowlines, where the risers are interfaced with a floating storage facility such as a FPSO, semi-submersible production vessel, etc. With deep water subsea production systems it is advantageous from a cost perspective to provide a rigid flowline (e.g., steel, etc.) as a riser, yet a means is necessary to decouple vessel motions and induced loads from a rigid pipe system. Typically, a flexible pipe between the rigid flowline and the vessel is used for this purpose. A rigid flowline coupled to a flexible hose-like riser is called a hybrid riser system.

U.S. Pat. No. 5,639,187 discloses a marine riser system which combines rigid steel catenary risers (called SCRs) with flexible "hose-like" pipe or flowlines. The SCRs extend from the sea floor in a gentle catenary path to a large submerged buoy positioned at a depth below the turbulence zone of the sea. Flexible risers are connected to the SCRs at the submerged buoy and extend upwardly to a floating platform or vessel used as a surface production and/or storage and off loading facility.

FIG. 1 illustrates a prior art arrangement which includes a floating vessel 10 such as a Floating Production, Storage and Offloading (FPSO) vessel floating on a sea surface 30 and secured to a seabed 32 by means of anchor legs 16 which substantially prevent rotation of a turret 12 which is rotationally supported on vessel 10. In other words, the vessel is capable of weathervaning about the stationary turret 12 under forces of wind, currents and waves. Steel Catenary Risers (SCR) 14 run from seabed 32 sources of hydrocarbons (not shown) to a Steel Catenary Riser Interface Buoy 18, called a "SCRIB. A flexible riser hose 20, typically suspended in a double catenary configuration, is coupled to each SCR 14 at SCRIB 18. The upper end of each flexible riser 20, runs to the turret 12 and connects to a fluid coupling (i.e., a swivel) and then via a pipe to a vessel holding tank.

In the prior art arrangement of FIG. 1, if the upper ends of SCR's 14 at SCRIBs 18 are not restrained in some way, they are free to move in response to vortex-induced vibrations (VIV) or disparate current effects. In order to decrease the effects of such sea current forces, a prior art arrangement provides a link 22 coupled between the turret 12 (or to an auxiliary device secured to the turret 12) and to the SCRIB 18 for each riser. The link 22 provides substantial stability to a riser, and links 22 for all of the risers provide enhanced stability to the system. The tension load of a link 22 need be only a fraction of the load of the SCR 14 itself, because much of that load is reduced by the SCRIB 18. A system of tension links 22, one for each riser 14, advantageously also prevents fouling of the multiple risers with one another. A constant tension device may be coupled to each top tension link 22 to minimize the magnitude of vessel motions transferred to the risers.

IDENTIFICATION OF OBJECTS OF THE INVENTION

An object of this invention is to provide an improved riser system and method for its installation which stabilizes the upper ends of catenary risers.

Another object of the invention is to provide an improved riser system in which the risers are tensioned by the utilization of buoys and other arrangements connected to the steel tubular riser portion from the seabed to the buoy.

A further object of the invention is the provision of a riser system including installation methods which utilize an adjustable buoyancy for the riser buoys or provide new arrangements for increasing tension in the SCRs or for cross-linking upper end portions of the risers to each other for forceful interdependence.

SUMMARY OF THE INVENTION

Various methods and systems are provided for SCR/flexible mooring systems in order to minimize vortex-induced vibration (VIV) or disparate current effects. According to one aspect of this invention, several arrangements are provided for cross-linking of SCR's in a riser system to provide forceful interdependence of the risers for the purpose of enhancing stability. According to another aspect of the invention, the tension of the SCR portion of the riser system is increased in order to increase the SCR's natural frequency of vibration, and as a consequence, reduce VIV.

BRIEF DESCRIPTION OF THE DRAWINGS

FIGS. 4A, 4B, 5A, 5B, 5C, 6 and 7 illustrate several alternative arrangements for providing added tension to the SCR portion of the riser system.

DESCRIPTION OF PREFERRED EMBODIMENTS OF THE INVENTION

Riser Cross-Link Alternative

As described above, SCR's 14 supported with only a buoy such as a SCRIB (or similar arrangement), essentially have their upper ends "free" to move in response to vortex-induced vibration (VIV) or disparate current effects. Such sensitivity of movement, for example of the SCR's 14' and SCRIB's 18' shown in dashed lines in FIG. 2 is a significant problem for arrangements of multiple proximate risers.

Figure 1:
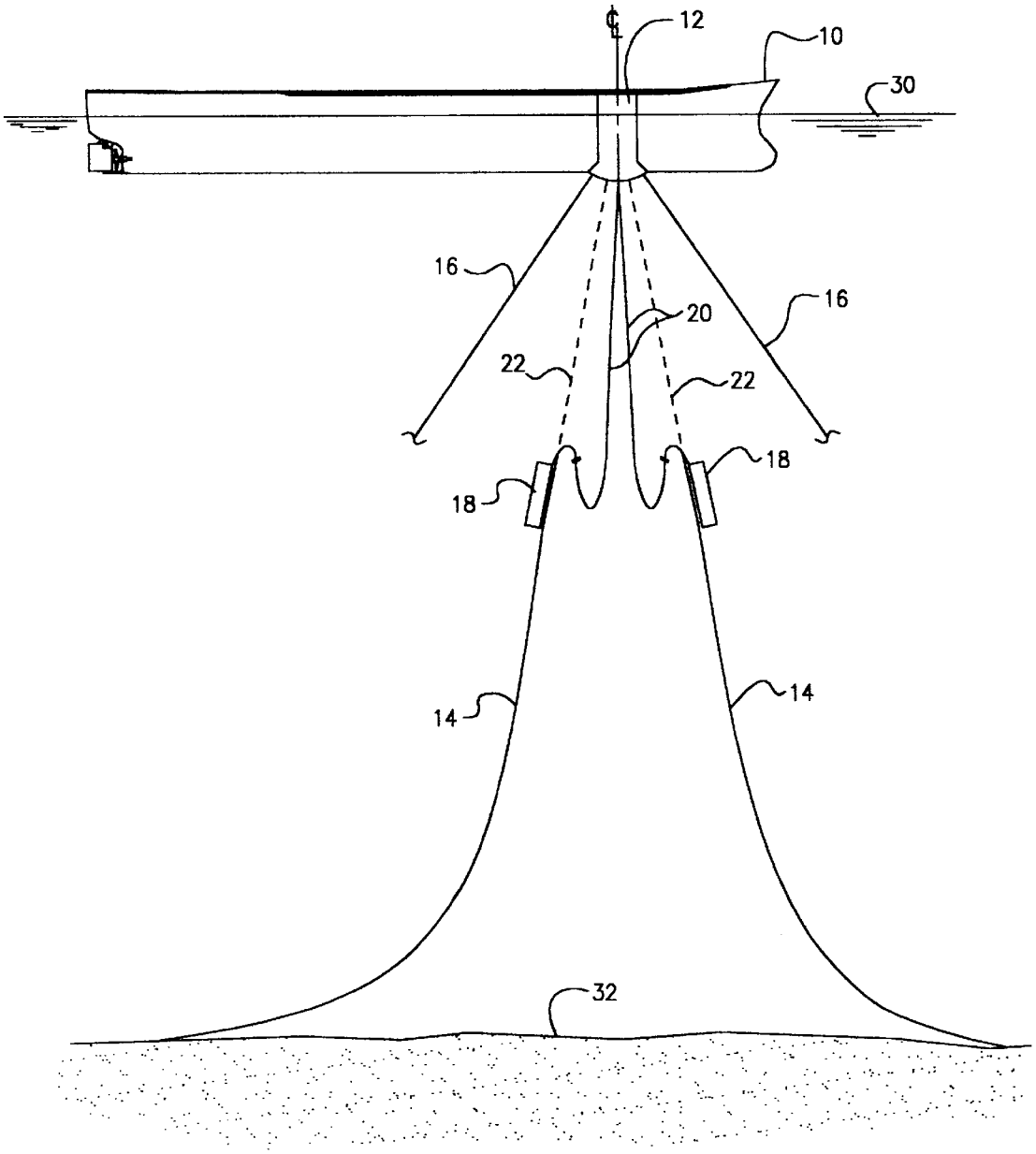
FIG. 1 (PRIOR ART)
FIG. 1 illustrates a prior art turret moored vessel with a riser system which includes a SCR from the sea floor to a SCRIB and with flexible hoses running from the SCR at the SCRIB to the vessel via a turret and with tensioning links running from the turret to the top of the SCR in order to apply tension in the SCRs and to stabilize the top of the SCR.
Figure 2:
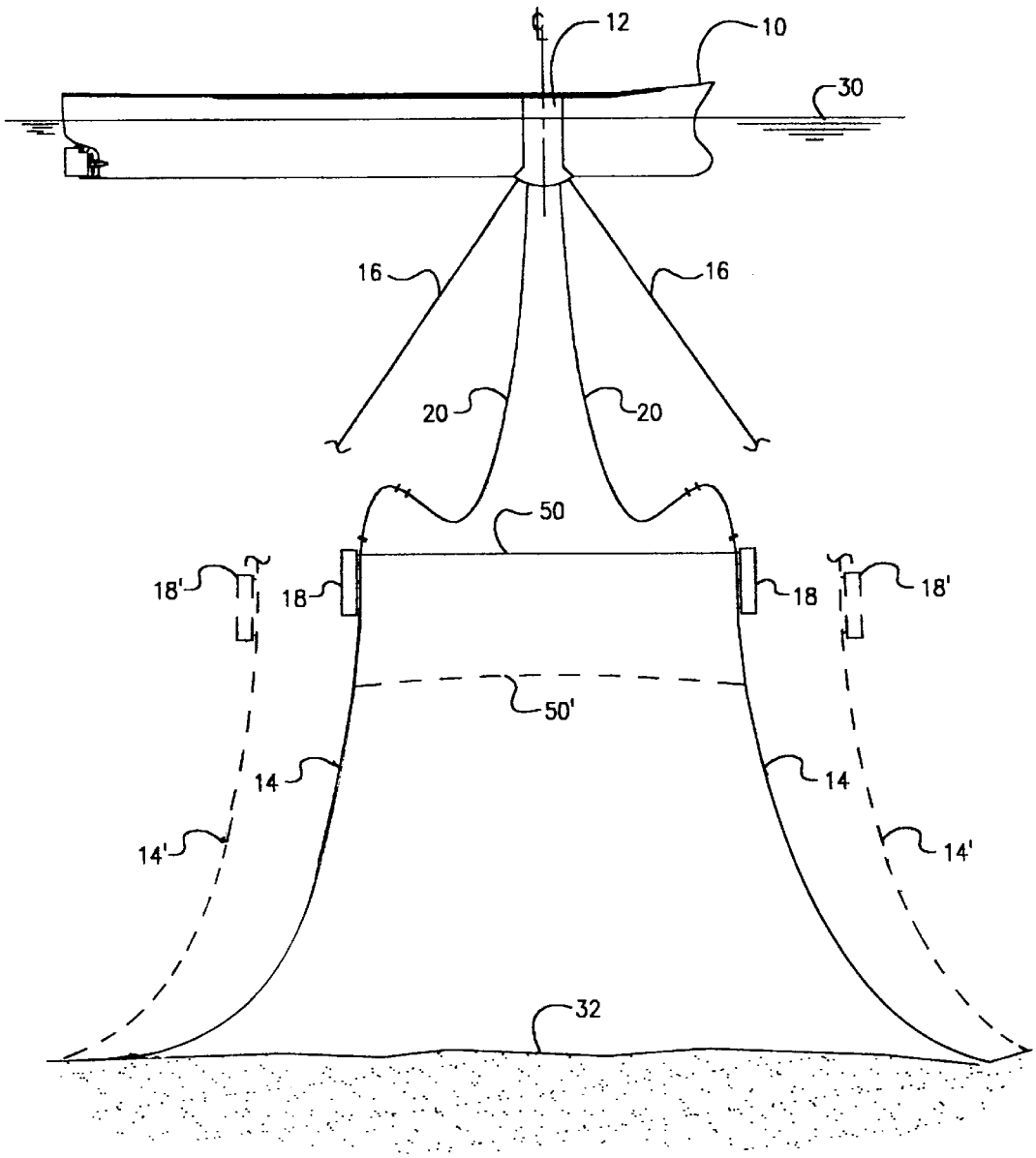
FIG. 2 is a diagramatic sketch of a riser system similar to that of FIG. 1, but with cross-links between SCR portions of risers of the riser system.

In order to reduce such sensitivity, the solid line arrangement of FIG. 2 provides a cross-link 50, under tension between the top level of the riser (e.g., at the height of the position of the SCRIB 18), or below it as shown by cross-link 50' shown in a dashed line. The cross-linking of the risers produces a "forceful interdependence" on the riser system, thereby serving to stabilize the riser system.

The cross-links 50 and/or 50' may be tension only members, such as cables, or they may be tension/compression members, such as beams, or trusses, or clamping rail/rack arrangements or even a more substantial solid three-dimension structure coupled to the risers. The tension/compression member and three-dimensional structures are advantageously effective in preventing inter-riser contact.

The Riser Cross-Link (RCL) arrangement of FIG. 2 controls the top end of the SCRIBs 18 without transferring substantial tension loads to the floating facility (such as vessel 10) or linking vessel motions to the risers 14. The RCL arrangement of FIG. 2 maintains the advantage of de-coupling vessel 10 motions from the risers 14 with the SCRIBs 18 producing low-load influence of the riser 14 to the vessel 10. Advantages are long fatigue life of the risers, less wear on turret bearings, etc.

Figure 3A:
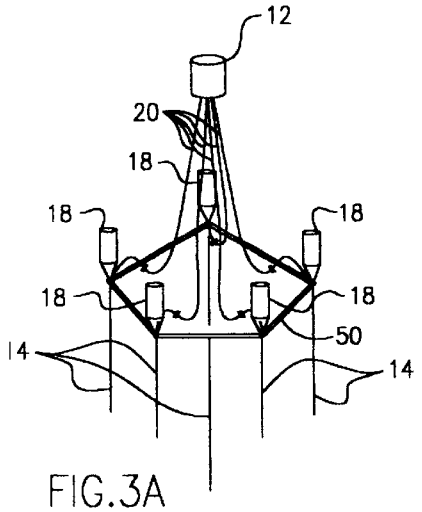
FIGS. 3A, 3B, 3C, 3D, 3E, and 3F illustrate several examples of cross-linking arrangements for the SCR portions of a riser system.

FIGS. 3A–3F illustrate several possible RCL arrangements. FIG. 3A diagrammatically shows cross-links 50, in the form of beams connected in a ring to each of the SCRIBs 18 with the flexible risers 20 extending to turret 12.

Figure 3C:
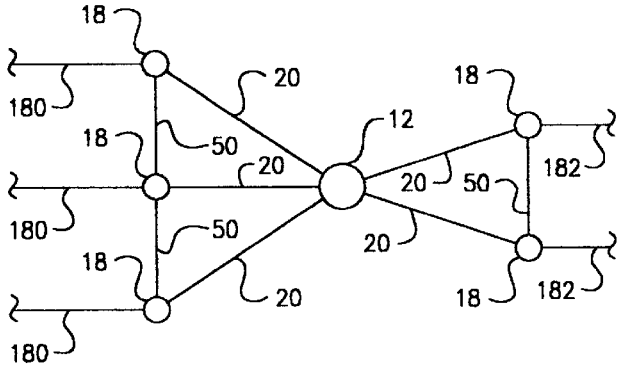
Figure 3D:
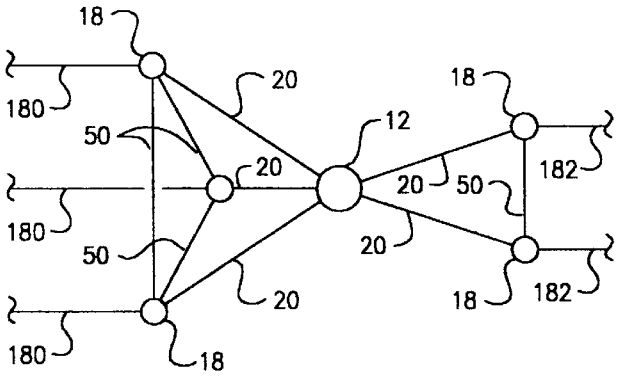
Figure 3E:
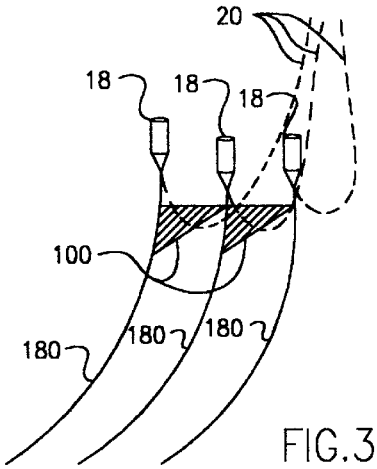
Figure 3F:
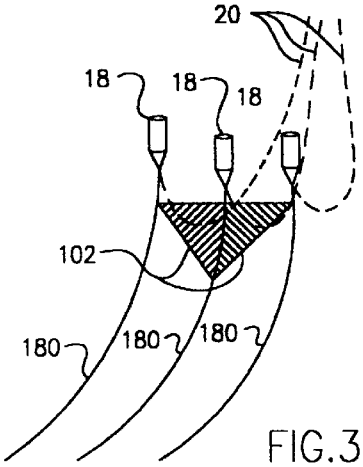
Figure 3B:
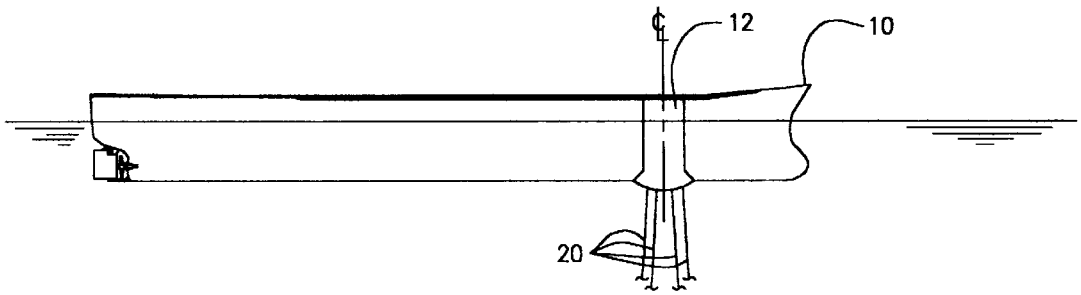
Figure 3B:
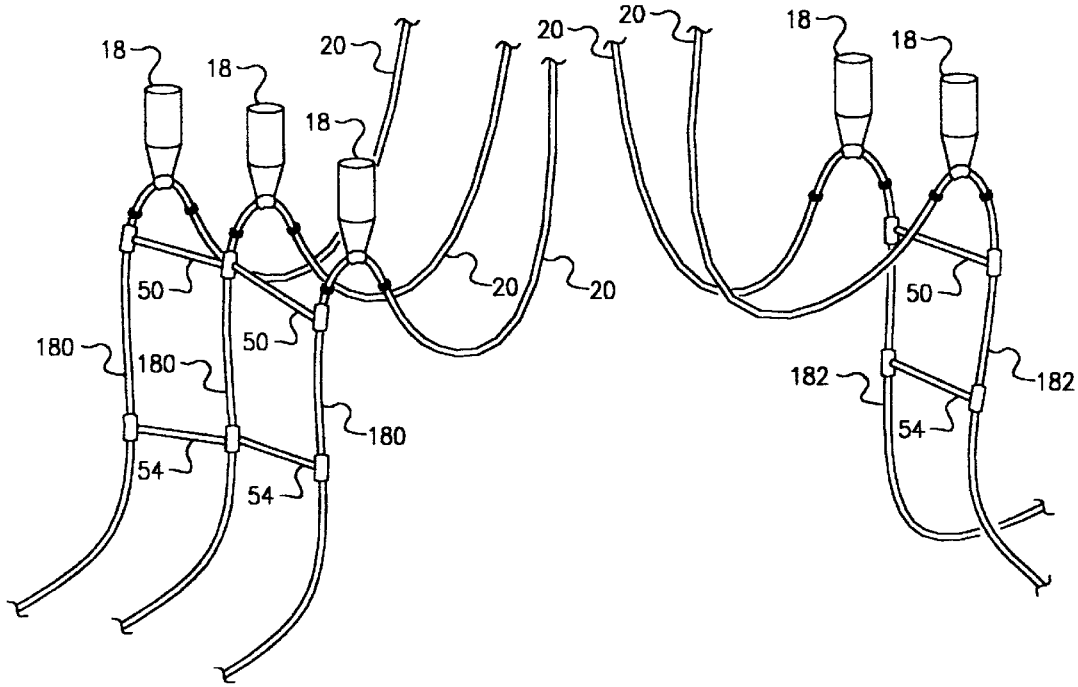

FIG. 3B illustrates in an elevation view three incoming or "importing" riser lines 180, 20 and two "export" lines 20, 182 connected to turret 12. Cross-link beams 50 and 54 are attached to SCRs 14 at the level of SCRIBs 18 and at a distance below. FIGS. 3C and 3D illustrate, in top views, importing risers 180, 20 and outgoing or "export" risers 20, 182. Cross-links 50 are established between SCRIBs 18 in the arrangements of FIG. 3C and 3D. The FIG. 3C arrangement shows incoming cross-links 50 placed perpendicularly between risers 180 at SCRIBs 18, while the FIG. 3D shows incoming cross-links 50 arranged in a trianglular pattern.

FIGS. 3E and 3F, elevation diagrams of the incoming risers 180, show triangular members 100 (FIG. 3E) 102 (FIG. 3F) which are generally independent of each other, thereby allowing them to link risers in pairs to accommodate "out of plane" arrays of multiple risers. Members 100, 102 may be open beam arrangements (e.g., truss-like members) or solid planer structures, possibly characterized by positive buoyancy. Sets of links may be provided at multiple positions along the lengths of the risers if desired.

Tension Enhancement of Single Steel Catenary Riser (SCR)

The alternatives described above are intended to provide stability for multiple riser arrangements to prevent inter-riser contact.

Another problem of risers is Vortex Induced Vibration (VIV). One way to reduce VIV is to increase the inherent damping of the riser. Increasing damping of a metal riser is difficult to achieve because of its relative high stiffness/rigidity. Inclusion of compliant bushings at the interface between joints of pipe is one possible technique, but is inappropriate for welded risers. In the past, a common way to reduce VIV has been to disrupt fluid flow around the long slender riser by including helical strakes, fairings or various shroud arrangements about the riser. Such devices are called "vortex suppression devices."

The various VIV suppression devices noted above each have distinguishing characteristics. Helical strakes are by far the most popular because of their relatively low cost, wide availability and general ease of installation (for many applications). Unfortunately, they have a high drag coefficient (CD~1.4), and that drag coefficient is effective for the cylinder diameter defined by the outer surface of the strakes (not the bare pipe OD). Therefore, there may be "hidden costs" associated with strakes that could be overlooked, including the need for higher grade/increased wall section pipe to handle the high drag loads, associated higher welding, inspection and installation time/costs, etc.

Fairings, on the other hand, have an attractively low drag coefficient (Cd~0.4), and well designed fairings add little to the effective riser OD on which this Cd is imposed. Fairings are also highly effective at suppressing VIV. Unfortunately, fairings are very expensive to design, build, install and maintain, and are therefore rarely used.

Shrouds come in various forms, the most popular being "mesh"/"ported" or "vertically slotted" arrangements. Shrouds typically provide Cds on the order of 1.2. This Cd value is based on the bare pipe OD, at least for the "vertically slotted" geometry. The effectiveness of various shroud configurations at suppressing VIV on risers depends upon their design ("slotted" with large front and back openings considered "best", however, such a design works best in uni-directional currents). Similar to the fairings, shrouds can be expensive to design, build, install and maintain. Both fairings and shrouds are more easily damaged than helical strakes.

For bottom-fixed/top-tensioned risers (BF/TT, not shown), at least, it is common to see the highest practical top-tension for a given application being applied, and helical strakes being used over at least part of the riser length (typically the upper section, which is usually exposed to higher currents). SCRs require different issues to be taken into account when trying to avoid VIV.

First of all, SCR geometry is substantially different than the straight vertical arrangement exhibited by a bottom-fixed/top-tension design. While fluid flow around the latter is substantially a 2-D matter (at least until strakes are added), fluid flow around an SCR will have components in 3-D over much of its length, because of its catenary geometry.

The only tensile load being imposed on the SCRIB-suspended SCR is due to its own weight. This load is substantially less than that typically applied to a SCR suspended from a conventional platform, Tension Leg Platform or even a Tension Leg Riser Buoy (TLRB), which can be tensioned beyond its own weight by the interfacing surface facility. Specifically, there is less opportunity to "raise the natural frequency" of a SCR suspended from a SCRIB. The non-SCRIB suspended designs mentioned above can provide almost any level of tension in the riser as may be desired by the designer, so long as the buoy (vessel, TLRB, etc.) is anchored to the seabed. Adding buoyancy to the SCRIB design without limit would eventually result in the buoy being raised toward the sea surface making it subject to sea-surface influences, which is undesirable. Also, adding buoyancy to the TLRB design is expensive compared to other configurations, since with the buoy anchor line in place, more buoyancy must be added to get the same tensile stress increase in a pipe. For a Free Standing Riser (FSR), for example, all added buoyancy directly affects riser tension.

The characteristics described represent design opportunities for the SCR portion of a SCRIB riser system.

(1) De-coupling of the SCR portion of the riser from the vessel (as in a SCRIB design) provides advantages from the vessel standpoint and from the riser standpoint. Decoupling of motions and loads is achieved. Of course, there are trade-offs when providing a SCRIB buoy and a flexible riser from the SCR to the vessel.

(2) Tensioning capability of the SCR portion may be effectively provided by buoyancy, especially if the buoyout force can be resisted solely along the axis of the riser.

(3) Increasing tension on the SCR portion by increasing buoyant force can be an effective method to increase riser natural frequency (to resist VIV), especially if a correctly designed anchoring system can be exploited.

(4) Even when decoupled from vessel motions, the SCR portion of the riser will be subject to bending and tensile load variations (hence fatigue loadings) in response to varying currents. It is not possible to fully decouple the SCR portion from the vessel, because at least a flexible riser pipe is needed to complete the flow path between the SCR and the vessel, and high drag VIV suppressors make things worse.

(5) Opportunistically arranging the "approach" of multiple risers in an "opposing array" provides "load sharing" advantages. By increasing buoyancy after cross-link coupling has been established, such as by increasing buoyancy for "air cans", lateral displacement of the SCRs is to a great extent prevented by the balancing effects of the array. The "opposing array" arrangement is advantageous compared with independently anchoring of individual risers.

Figures 4A, 4B:
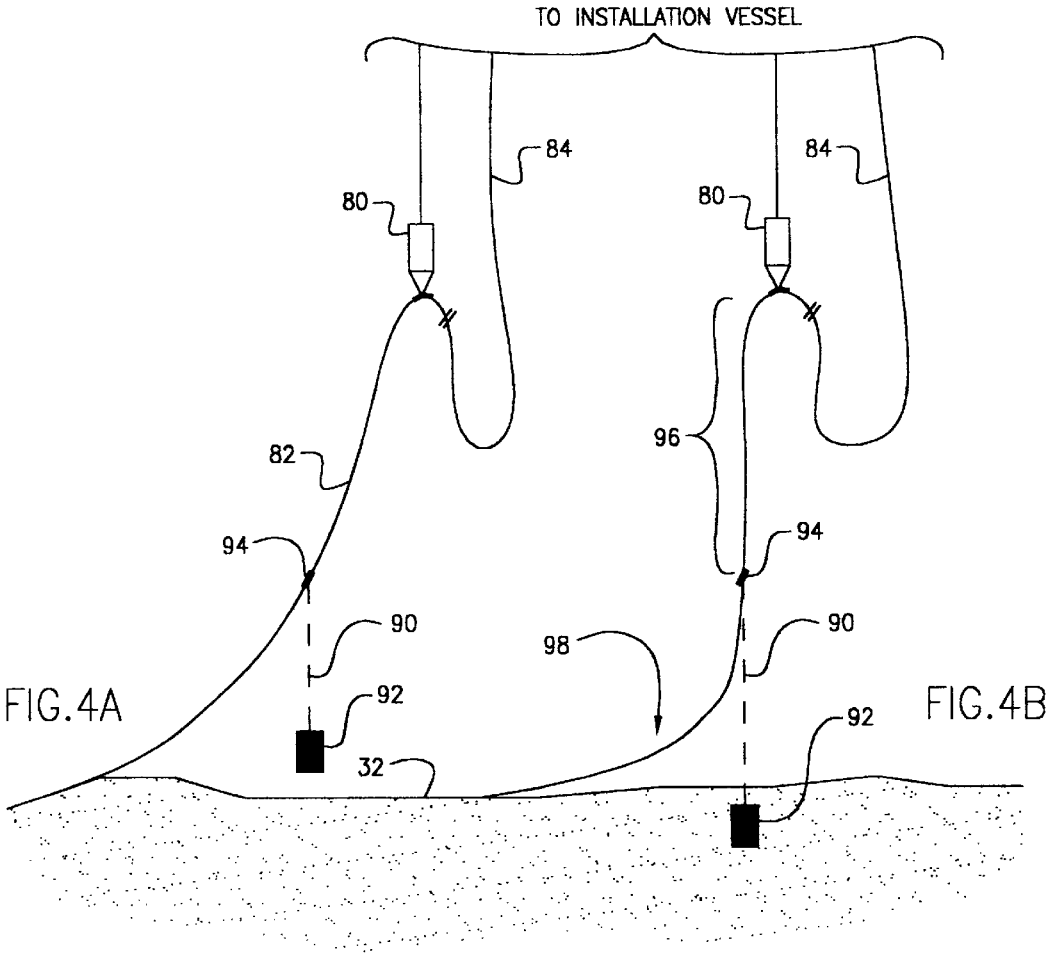

FIGS. 4A and 4B illustrate an arrangement of a SCRIB buoy 80 which supports a SCR 82 and a flexible riser 84 extends from the end of the SCR 82 to an installation vessel. FIG. 4A shows an auxiliary anchor line 90 with an anchor 92 attached thereto at a point 94 substantially above the seabed interface of SCR 82. FIG. 4B shows the SCR 82 after the anchor 92 has landed on seabed 32. An induced bend or natural sag bend portion 98 is created in the SCR 82 from the seabed 32 to the connection point 94 (or beyond). Additional buoyancy can be added by increasing the SCRIB air can 80 buoyancy, if desired, in order to produce a substantially vertical portion 96 between connection point 94 and SCRIB buoy 80. Thus, increased tension is achieved along substantially vertical portion 96, thereby increasing the natural frequency of vibration of SCR 82, and as a consequence, reducing VIV potential. Ultimately, flexible riser 84 is coupled to a floating facility.

FIGS. 5A, 5B, 5C illustrate another arrangement and method for its installation to produce tension in SCR 82 and thus reduce VIV. In FIG. 5A, a bend restricting mandrel 105 is attached at points 107 to the "heel" portion of SCR 82. FIG. 5B shows that the bend restricting mandrel 105 is caused to engage and be secured (by weight, etc.) to the sea floor 32. FIG. 5C shows that by forcing the SCR to assume the shape of the bend restricting mandrel, (e.g., by permanently deforming the heel) a substantially vertical portion 83 extends from the top of the mandrel 105 to the SCRIB buoy 80. This concept effectively transfers a SCR into a FSR, and increases the effectiveness of buoyancy for tensioning the vertical section of the riser. Flexible riser 84 is illustrated during installation as running to an installation vessel. Ultimately they are coupled to a floating facility.

FIG. 6 illustrates another arrangement for producing tension in the SCR portion 82 of the riser arrangement. A bend restrictor/mandrel 108 is installed at the seabed 32 portion of the SCR 82 and redirects the SCR 82 to a vertical orientation with increased tension therein. The radius of bend restrictor 108 is large enough so that the SCR 82 can bend about it without significant reduction of its design life.

Figure 7:
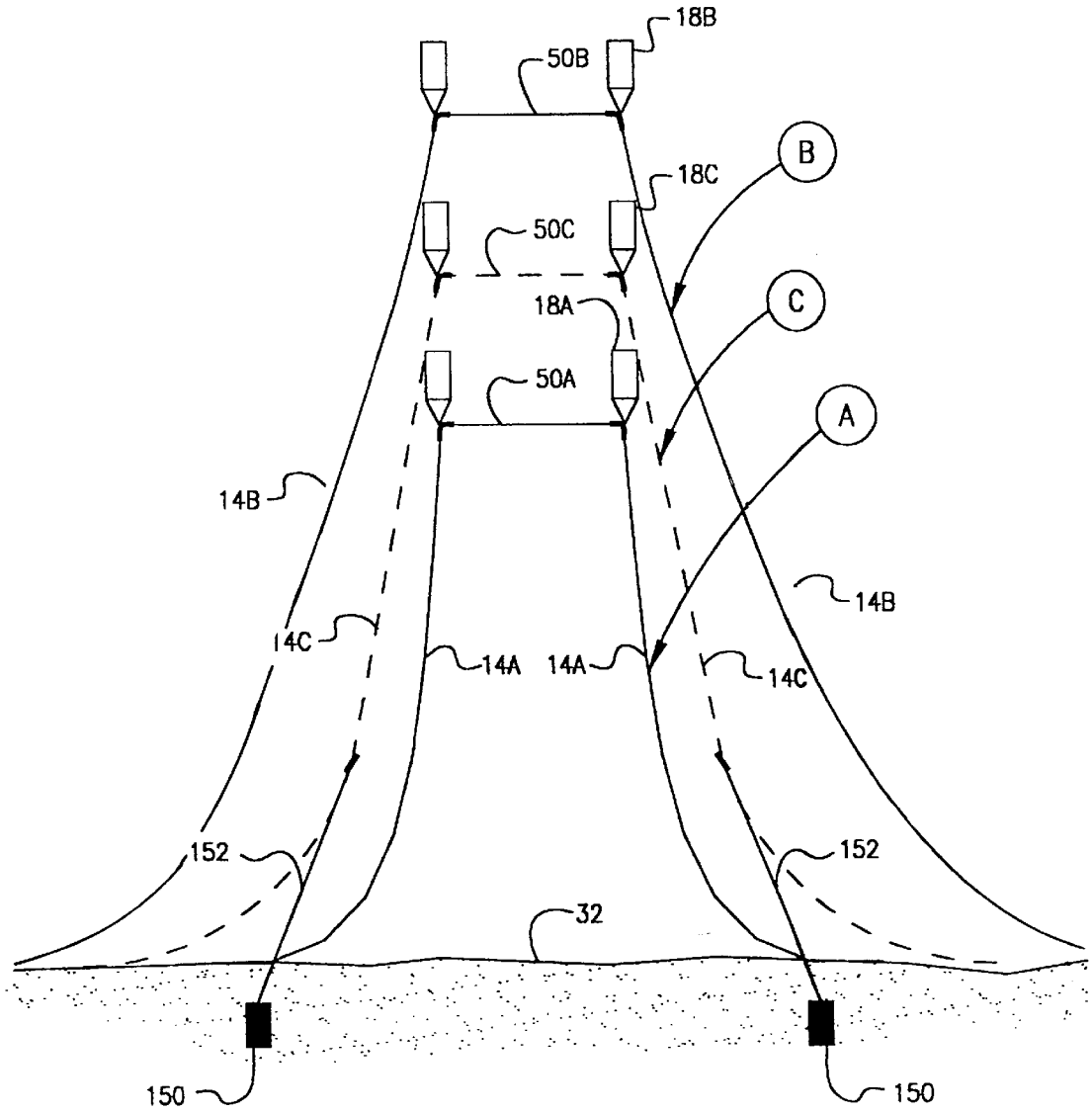

FIG. 7 illustrates still another arrangement for achieving tension in the substantially vertical portion of the SCR portion of the riser arrangement. These arrangements A, B, and C are superimposed to show comparisons of tension imposed and resulting geometry of the risers. In each of the arrangements, opposing risers are cross-linked together, much like with the arrangement of FIG. 2. The flexible hose sections of the risers are omitted from this diagram for clarity. The opposing riser array labeled A has relatively little buoyancy in its SCRIB buoys 18A. The opposing riser array labeled B has substantially more buoyancy in the SCRIB buoys 18B than those of array A. The opposing riser array labeled C has about the same buoyancy as that of array B, but anchors 150 are connected to legs 152 which are secured to the lower portion of risers 14C. The anchor legs 152 and anchors 150 prevent uplift of SCR 14C lower section while providing more tension force in the upper section of the SCR. As a result, the natural frequency of vibration is increased in the SCR 14C, thereby minimizing VIV in it and possibly eliminating the need for other devices for VIV suppression. The riser array labeled A provides increased tension in SCRs 14A as compared to non-cross-linked risers. The riser array labeled B provides even higher tension in SCRs 14B as compared to that of SCRs 14A. The riser array labeled C provides much higher tension in SCRs as compared to that of arrays 14A or 14B.

While preferred embodiments of the present invention have been illustrated in detail, it is apparent that modifications and adaptations of the preferred embodiments will occur to those skilled in the art. The term SCR is intended to mean, in this written specification and in the claims, not only a riser made of steel, but also one made of engineered composite materials. Likewise, the term Steel Tubular Line includes tubular members made of steel and also of engineered composite materials. It is to be expressly understood that such modifications and adaptations are within the spirit and scope of the present invention as set forth in the following claims.

What is claimed is:

1. An improved riser arrangement for a moored floating facility, the arrangement including a plurality of risers, each of which provides a fluid flow path between a seabed position and the floating facility in the sea, where each riser includes, a steel catenary riser which extends from a first end at a seabed position to a second end at a submerged depth position in the sea, said steel catenary riser having a catenary shape between said seabed position at said first end and said submerged depth position at said second end, a flexible riser coupled at one end to said second end of said steel catenary riser to form a fluid flow path from said seabed position to an opposite end of said flexible riser, said opposite end of said flexible riser being coupled to said floating facility, and a submerged steel catenary riser interface buoy positioned at said submerged depth position which supports said steel catenary riser and said flexible riser at said submerged depth position, where each steel catenary riser interface buoy for a riser is independent of each other steel catenary riser interface buoy for any other riser of said plurality of risers, said improved riser arrangement including an improvement which comprises, a cross-link positioned between and coupled to at least two of said steel catenary risers, said cross-link thereby enhancing stability of said steel catenary risers.

2. The improved riser arrangement of claim 1 wherein said cross-link is a cable.

3. The improved riser arrangement of claim 1 wherein said cross-link is a beam.

4. The improved riser arrangement of claim 1 wherein said cross-link is a structure, arranged and designed for both tension and compression loads.

5. The improved riser arrangement of claim 4 wherein said structure is a triangular shaped structure, said structure leaving a first side of which extends in a perpendicular direction to and is connected to said at least two steel catenary risers, a second side which extends along and is connected to one of said at least two steel catenary risers, and a third side which forms the hypotenuse of a triangular shape of said triangular shaped structure.

6. The improved riser arrangement of claim 1 wherein said each of said plurality of steel catenary risers has a cross-link provided to another steel catenary riser in said plurality of steel catenary risers.

7. The improved riser arrangement of claim 1 wherein certain risers of said plurality of risers are import risers and certain other risers of said plurality of risers are export risers, and the improvement further comprises, one or more cross-links positioned between steel catenary risers of said import risers, and one or more cross-links positioned between steel catenary risers of said export risers, and wherein cross-linking of said import risers is independent of cross-links of said export risers.

8. The improved riser arrangement of claim 1 wherein, said cross-link is positioned between said at least two of said steel catenary risers at a level at said steel catenary riser interface buoys.

9. The improved arrangement of claim 8 further comprising, at least another cross-link positioned between said at least two of said steel catenary risers at a level below said steel catenary riser interface buoys.

10. The improved riser arrangement of claim 1 wherein, said cross-link is positioned between said at least two of said steel catenary risers at a level below said steel catenary riser interface buoys.

11. An improved riser arrangement for a moored floating facility in the sea, the arrangement including a plurality of risers, each of which provides a fluid flow path between a seabed location and the floating facility, where each riser includes, a tubular line which extends from said seabed location at a first end to a submerged depth position at a second end in the sea, a flexible hose riser coupled at one end to said second end of said tubular line to form a fluid flow path from said seabed location to an opposite end of said flexible hose riser, said opposite end of said flexible hose riser being coupled to said floating facility, and a submerged interface buoy positioned at said submerged depth position which supports said tubular line and said flexible hose riser at said submerged depth position, where each submerged interface buoy for a riser of said plurality of risers is independent of each other submerged interface buoy for any other riser, said arrangement including an improvement which comprises, a cross-link positioned between at least two of said tubular lines, said cross-link enhancing stability of said tubular lines, and a first line connected to a first of said at least two of said tubular lines at a first securement position and having a first anchor connected to an opposite end of said first line and extending to the seabed, and a second line connected to a second of said at least two of said tubular lines at a second securement position and having a second anchor connected to an opposite end of said secured line and extending to the seabed, said first and second lines and said first and second anchors being arranged and designed to increase the tension in said tubular lines between said first and second securement positions and said submerged interface buoy of each of said at least two of said tubular line.

* * * * *